US012416212B2

(12) United States Patent
Atkins

(10) Patent No.: US 12,416,212 B2
(45) Date of Patent: Sep. 16, 2025

(54) MILLING TOOL

(71) Applicant: Paul Atkins, Phuket (TH)

(72) Inventor: Paul Atkins, Phuket (TH)

( * ) Notice: Subject to any disclaimer, the term of this patent is extended or adjusted under 35 U.S.C. 154(b) by 215 days.

(21) Appl. No.: 17/766,354

(22) PCT Filed: Oct. 20, 2020

(86) PCT No.: PCT/AU2020/051130
§ 371 (c)(1),
(2) Date: Apr. 4, 2022

(87) PCT Pub. No.: WO2021/077160
PCT Pub. Date: Apr. 29, 2021

(65) Prior Publication Data

US 2023/0265727 A1 Aug. 24, 2023

(30) Foreign Application Priority Data

Oct. 21, 2019 (SG) ..... 10201909833S

(51) Int. Cl.
*E21B 29/00* (2006.01)

(52) U.S. Cl.
CPC ..... *E21B 29/005* (2013.01)

(58) Field of Classification Search
CPC ..... E21B 29/005; E21B 29/00; E21B 29/002; E21B 10/322; E21B 10/345
See application file for complete search history.

(56) References Cited

U.S. PATENT DOCUMENTS 2,548,931 A * 4/1951 Baker ..... E21B 10/322 175/269
2,654,575 A * 10/1953 Kammerer ..... E21B 10/345 175/391
2,690,897 A * 10/1954 Clark, Jr. ..... E21B 29/005 175/266
3,050,122 A * 8/1962 Huitt ..... E21B 47/095 175/269

(Continued)

FOREIGN PATENT DOCUMENTS

WO 2011/115941 A1 9/2011
WO 2012/087712 A2 6/2012

(Continued)

OTHER PUBLICATIONS

International Search Report Issued—Nov. 24, 2020 For Corresponding PCT Application No. PCT/AU2020/051130.

(Continued)

*Primary Examiner* — George S Gray
(74) *Attorney, Agent, or Firm* — Michelle L. Gross, P.C.

(57) ABSTRACT

A milling tool for cutting an outer casing string of a wellbore, the milling tool comprising a tool body, an extendable cutting member located in the tool body configured to cut the outer casing string, and an extendable reaming block located in the tool body configured to clean a window formed in an inner casing string of the wellbore, wherein the reaming block is configured to extend from the tool body independently from the cutting member, and wherein the cutting member and the reaming block are configured to extend from the tool body by circulating drilling fluid through the milling tool.

17 Claims, 9 Drawing Sheets

(56) References Cited

U.S. PATENT DOCUMENTS

| | | | | |
|---|---|---|---|---|
| 4,431,065 | A * | 2/1984 | Andrews | E21B 10/567 175/269 |
| 4,893,675 | A | 1/1990 | Skipper | |
| 5,070,952 | A * | 12/1991 | Neff | E21B 10/46 175/426 |
| 5,810,079 | A * | 9/1998 | Lynde | E21B 29/002 166/55.6 |
| 2011/0220357 | A1* | 9/2011 | Segura | E21B 29/005 166/55.3 |
| 2013/0199785 | A1* | 8/2013 | Hekelaar | E21B 29/005 166/55.7 |
| 2015/0275605 | A1 | 10/2015 | Bennett et al. | |
| 2015/0354306 | A1* | 12/2015 | Fuller | E21B 17/1078 166/55.7 |

FOREIGN PATENT DOCUMENTS

| | | | |
|---|---|---|---|
| WO | 2012/087712 | A3 | 6/2012 |
| WO | 2015/054227 | A2 | 4/2015 |
| WO | 2015/054227 | A3 | 4/2015 |
| WO | 2015/191572 | | 12/2015 |

OTHER PUBLICATIONS

Supplemental Partial European Search Report Issued on Nov. 2, 2023 For Corresponding European Patent Application No. 20879434.7.

* cited by examiner 12
214
218
217
232
233
230
231
213
216
223
210
224
212
200
240b
220
222
221
240a
140
120
211
130
215
100
10
110
11
15

12
214
217
218
232
230
231
213
120
210
223
224
212
221
240b
222
240a
140
200
211
130
215
100
110
10
11
15

MILLING TOOL

CROSS REFERENCE TO RELATED APPLICATIONS

This application is a National Stage Application, filed under 35 U.S.C. 371, of International Patent Application No. PCT/AU2020/051130, filed on Oct. 20, 2020, which claims priority to Singapore patent application Ser. No. 10/201, 909833S filed on Oct. 21, 2019, contents of both of which are incorporated herein by reference in their entireties.

FIELD OF THE INVENTION

The invention relates to a milling tool. In particular, the invention relates, but is not limited, to a milling tool in the form of a dual string section mill for cutting/milling a window in an outer casing string of a wellbore and an expandable under-reamer.

BACKGROUND TO THE INVENTION

Reference to background art herein is not to be construed as an admission that such art constitutes common general knowledge in Singapore or elsewhere.

Oil and gas wells are ordinarily completed by first cementing metallic casing strings in the borehole. Depending on the properties of the formation (e.g., formation porosity), dual casing strings may be employed, for example, including a smaller diameter casing string (inner string) deployed internal to a larger diameter casing string (outer casing string). In such dual or multiple casing string wellbores, the internal string is commonly cemented to the larger diameter string (i.e., the annular region between the first and second strings is filled or partially filled with cement).

When oil and gas wells are no longer commercial viable, they must be abandoned in accordance with local government regulations. In certain jurisdictions, well abandonment requires a length of the wellbore casing to be removed prior to filling the wellbore with a cement plug. The inner casing string is commonly removed via a milling operation that employs a single inner string section milling tool. However, milling a dual outer casing string typically requires a dual string section mill with larger knife extension sweep/arc than the single inner string section milling tool used for milling the inner casing string. A separate inner string window clean out operation may also be required to remove the cement layer or other debris located between the inner and outer casing strings. These multiple operations are both time consuming and expensive and therefore are undesirable. Milling blades are prone to failure as they can bend or break during use. The use of larger diameter milling blades can also be problematic in that the larger blades are subject to increased shear and torsional loads. Larger diameter blades are also difficult to fully collapse into a tool body.

OBJECT OF THE INVENTION

It is an aim of this invention to provide a milling tool which overcomes or ameliorates one or more of the disadvantages or problems described above, or which at least provides a useful alternative.

Other preferred objects of the present invention will become apparent from the following description.

SUMMARY OF INVENTION

In one form, although not necessarily the only or broadest form, the invention resides in a milling tool for cutting an outer casing string of a wellbore, the milling tool comprising:

- a tool body;
- an extendable cutting member located in the tool body configured to cut the outer casing string; and
- an extendable reaming block located in the tool body configured to clean a window formed in an inner casing string of the wellbore,
  - wherein the reaming block is configured to extend from the tool body independently from the cutting member, and
- wherein the cutting member and the reaming block are configured to extend from the tool body by circulating drilling fluid through the milling tool.

Preferably, the milling tool is a dual string section mill. Preferably, the milling tool has a first end and a second end. Preferably, the first and second ends can be coupled with a drill string.

Preferably, the tool body has an inner assembly and an outer assembly. Preferably, the inner assembly has an inner housing and an inner mandrel connected to the inner housing. Preferably, the cutting member is connected to the inner housing.

Preferably, the inner housing has a central bore that provides a fluid pathway for the drilling fluid. Preferably, the inner mandrel is aligned with the central bore of the inner housing.

Preferably, the inner housing comprises a J-slot portion that engages with the outer housing. Preferably, engagement of the J-slot portion with the outer housing allows for rotational torque to be transmitted to the outer assembly from the inner assembly.

Preferably, the cutting member comprises a knife arm. Preferably, a distal portion of the knife arm includes a plurality of cutting elements. Preferably, the milling tool includes at least three cutting members.

Preferably, the cutting member engages with the reaming block. Preferably, an engaging portion of the cutting member engages with an engaging portion of the reaming block. Preferably, the engaging portion of the cutting member includes a linear projection. Preferably, the engaging portion of the reaming block includes a linear recess.

Preferably, the outer assembly is slidable relative to the inner assembly. Preferably, the outer assembly includes an outer housing. Preferably, the outer housing includes a knife portion, a middle portion, a nozzle portion and a bottom portion.

Preferably, the knife portion of the outer housing includes a cut-out for the cutting member to extend through and a cut-out for the reaming block to extend through.

Preferably, the outer assembly further includes a piston assembly for extending the reaming block. Preferably, the piston assembly is located in the outer housing.

Preferably, the piston assembly includes a knife ramp support block. Preferably, the reaming block is connected to the knife ramp support block. Preferably, the knife ramp support block includes a recess that engages with the engaging portion of the cutting member. Preferably, engagement of the knife ramp support block with the cutting member extends the cutting member from the tool body.

Preferably, the piston assembly further includes a wedge rod that extends through the knife ramp support block. Preferably, the wedge rod includes a projection that extends through a cut-out in the knife ramp support block. Preferably, the wedge rod is movable with respect to the knife ramp support block.

Preferably, the inner mandrel extends through the wedge rod.

Preferably, the piston assembly further includes a piston head and a spring located between the piston head and the knife ramp support block. Preferably, movement of the piston head moves the wedge rod relative to the knife ramp support block. Preferably, movement of the wedge rod causes the projection of the wedge rod to engage with the reaming block. Preferably, engagement of the projection of the wedge rod with the reaming block extends the reaming block from the tool body.

Preferably, pressure of the drilling fluid in the bottom portion moves the piston head.

Preferably, the milling tool has a plurality of reaming blocks. Preferably, the milling tool has a first extendable reaming block and a second extendable reaming block located in the tool body. Preferably, the second reaming block is spaced from the first reaming block along a longitudinal axis of the milling tool. Preferably, the second projection extends through the cut-out in the knife ramp support block.

Preferably, the wedge rod includes a plurality of projections. Preferably, the wedge rod includes a first projection and a second projection spaced from the first projection along a longitudinal axis of the milling tool. Preferably, movement of the wedge rod causes the first projection of the wedge rod to engage with the first reaming block and the second projection of the wedge rod to engage with the second reaming block. Preferably, engagement of the first projection of the wedge rod with the first reaming block extends the first reaming block from the tool body. Preferably, engagement of the second projection of the wedge rod with the second reaming block extends the first reaming block from the tool body.

Preferably, the first reaming block and the second reaming block extend simultaneously from the tool body. Preferably, the first and second reaming blocks are pivotally connected to knife ramp support block.

Preferably, the first and second reaming blocks extend in the same direction. Preferably, the first and second reaming blocks are identical in shape.

Preferably, the first and second reaming blocks extend in the opposite directions. Preferably, the first reaming block extends towards the first end and the second reaming block extends towards the second end. Preferably, the second reaming block is larger than the first reaming block.

Preferably, a nozzle is located on the tool body. Preferably, the nozzle is located in the nozzle portion of the outer housing. Preferably, the nozzle is an aperture formed in the nozzle portion. Preferably, when the first reaming block is extended, the drilling fluid can flow through the nozzle.

Preferably, the milling tool further comprises a shear assembly.

Preferably, the shear assembly includes a shear sleeve and a shear member releasably connected to the shear sleeve. Preferably, the shear assembly further includes a shear pin engaged with the shear sleeve and the shear member. Preferably, the shear pin prevents disengagement of the shear member from the shear sleeve.

Preferably, the shear assembly includes:

a shear sleeve;

an outer disconnect member operatively connected to the shear sleeve;

an inner disconnect member releasably engaged with the outer disconnect member; and a disconnect sleeve releasably engaged with the inner disconnect member.

Preferably, a locking member is located between the outer disconnect member and the disconnect sleeve. Preferably, the locking member engages with the outer disconnect member. Preferably, a projection of the locking member engages with a recess of the outer disconnect member. Preferably, the locking member engages with the inner disconnect member. Preferably, a base of the locking member engages with the inner disconnect member. Preferably, the base of the locking member has an arcuate cross-sectional shape.

Preferably, the shear assembly further includes a shear pin engaged with the inner disconnect member and the disconnect sleeve. Preferably, the shear pin prevents disengagement of the disconnect sleeve from the inner disconnect member.

Preferably, the disconnect sleeve is located inside the inner disconnect member. Preferably, the locking member prevents disengagement of the disconnect sleeve from the inner disconnect member.

Preferably, an O-ring is located between the disconnect sleeve and the inner disconnect member. Preferably, the O-ring prevents disengagement of the disconnect sleeve from the inner disconnect member.

Preferably, the inner mandrel extends through the shear sleeve. Preferably, the shear sleeve is connected to the outer housing.

Preferably, the milling tool can move between (i) a closed position where the cutting member and the reaming block are not extended, (ii) a first open position where the reaming block is extended and the cutting member is not extended, and (iii) a second open position where the cutting member and the reaming block are extended from the tool body.

Preferably, disengagement of the shear member from the shear sleeve moves the milling tool to the second open position.

In another form the invention resides in a method for cutting an outer casing string of a wellbore, the method comprising:

inserting a milling tool in the wellbore;

extending a reaming block located in a tool body of the milling tool;

cleaning a window formed in an inner casing string of the wellbore by the reaming block;

extending a cutting member located in the tool body; and cutting the outer casing string by the cutting member, wherein the cutting member and the reaming block are extended from the tool body by circulating drilling fluid through the milling tool.

Preferably, extending the reaming block includes moving a piston head located in the tool body by the drilling fluid. Preferably, moving the piston head includes applying force on the piston head by the drilling fluid.

Preferably, extending the reaming block includes engaging a projection of a wedge rod with the reaming block.

Preferably, cleaning the window formed in the inner casing string includes rotating the milling tool when the reaming block is extended into the window.

Preferably, extending the cutting member includes disengaging a shear member connected to the tool body from a shear sleeve. Preferably, disengaging the shear member from the shear sleeve includes dropping a ball on to the shear member and circulating the drilling fluid through the milling tool.

Preferably, extending the cutting member includes disengaging a disconnect sleeve from an inner disconnect housing. Preferably, extending the cutting member further includes disengaging the inner disconnect housing from an outer disconnect housing operatively connected to a shear sleeve. Preferably, the shear sleeve is connected to the tool body.

Preferably, disengaging the disconnect sleeve from the inner disconnect housing includes shearing a shear pin engaged with the disconnect sleeve and the inner disconnect housing. Preferably, shearing the shear pin includes dropping a ball on to the disconnect sleeve and circulating the drilling fluid through the milling tool.

Preferably, extending the cutting member further includes moving a knife ramp support block located in the tool body by the drilling fluid. Preferably, moving the knife ramp support block includes applying force on the shear sleeve by the drilling fluid.

Preferably, cutting the outer casing string includes rotating the milling tool when the cutting member is extended into the window.

Preferably, the milling tool is herein as described.

Further features and advantages of the present invention will become apparent from the following detailed description.

BRIEF DESCRIPTION OF THE DRAWINGS

By way of example only, preferred embodiments of the invention will be described more fully hereinafter with reference to the accompanying figures, wherein.

DETAILED DESCRIPTION OF THE DRAWINGS

Figures 1, 2, 3:
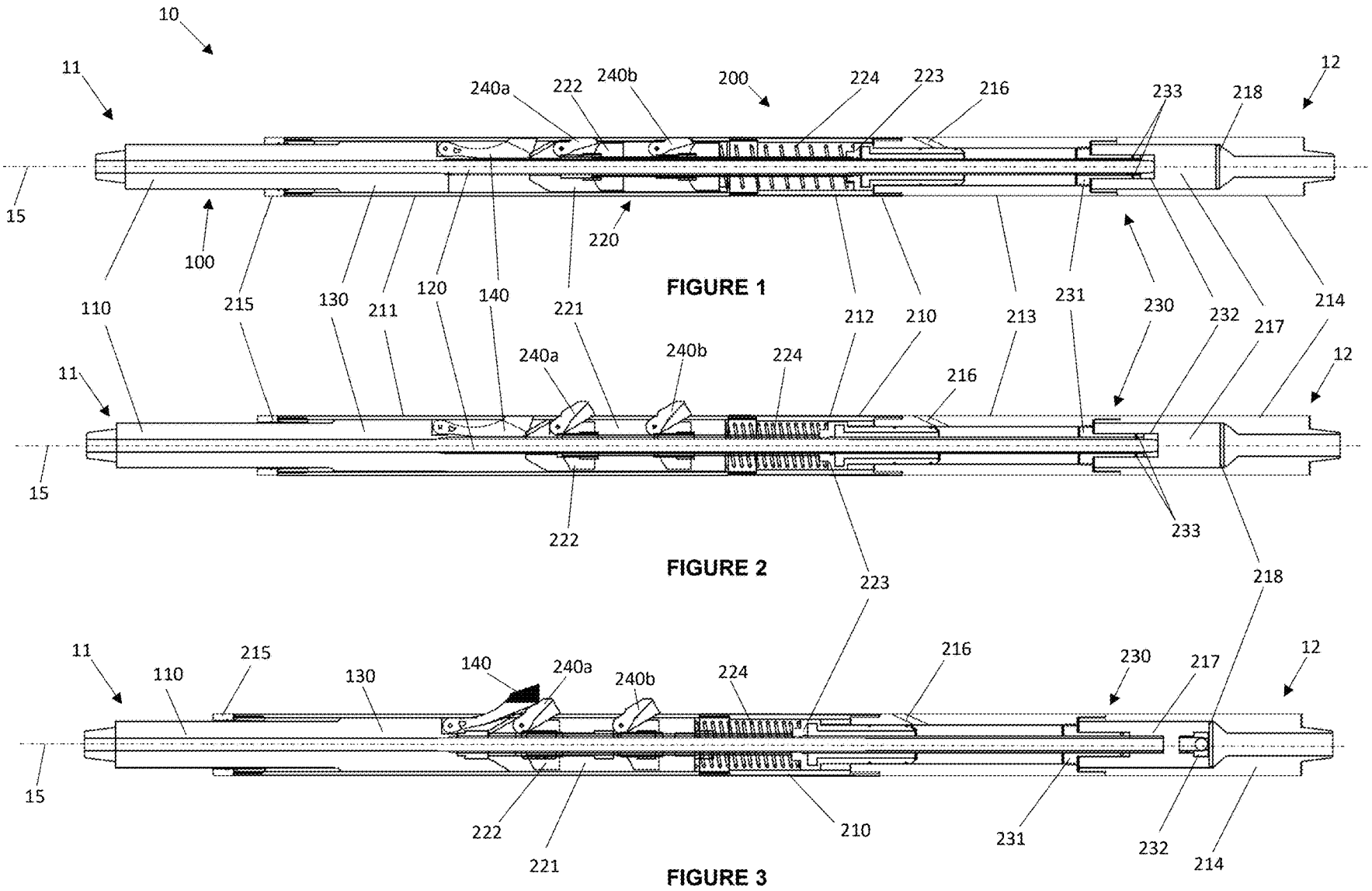
FIG. 1 illustrates a cross-sectional view of a milling tool, according to an embodiment of the invention.
FIG. 2 illustrates a cross-sectional view of the milling tool shown in FIG. 1 with the reaming blocks extended.
FIG. 3 illustrates a cross-sectional view of the milling tool shown in FIG. 1 with the knife arm and reaming blocks extended.

FIGS. 1-6 illustrate a milling tool in the form of a dual string section mill ('DSSM') 10 according to an embodiment of the invention. The DSSM 10 has a tool body including an inner assembly 100 and an outer assembly 200 that is connected and slidable relative to the inner assembly 100. The DSSM 10 has a first end 11 (which is a distal end of the inner assembly 100) and a second end 12 (which is a distal end of the outer assembly 200) which can be coupled with a drill string (or other tool string).

The inner assembly 100 comprises a cylindrical inner housing 110 with a central bore that provides a fluid pathway for drilling fluid and an inner mandrel 120 which also has a central bore that is aligned with the central bore of the inner housing 100.

A proximal end of the inner housing 110 includes a J-slot portion 130 that has a diameter that is slightly greater than that of the remaining inner housing 100. The J-slot portion 130 includes two recesses (in the form of J-slots) that are equally spaced from each other and located on opposite sides of the J-slot portion 130, and a plurality of cutting members in the form of knife arms 140 connected to the J-slot portion 130. Although only one knife arm 140 is shown in FIGS. 1-3, the DSSM 10 includes three knife arms 140 that are equally radially spaced from each other, with the knife arms 140 being pivotally connected to the J-slot portion 130 at points that lie in a common plane that is perpendicular to a longitudinal axis 15 of the DSSM 10. However, in further embodiments, the J-slot portion 130 may include only one or three or more recesses and/or the recesses may be shaped differently. Moreover, in further embodiments, the DSSM 10 may include only one, two or four or more knife arms, or the cutting members may be under-reaming arms instead of knife arms 140.

The distal portions of each knife arm 140 includes a plurality of cutting elements. Any cutting elements suitable for milling/removing cement and drilling formation may be utilized including, but not limited to, polycrystalline diamond cutter (PDC) inserts, thermally stabilized polycrystal line (TSP) inserts, diamond inserts, glyphaloy carbide inserts, boron nitride inserts, abrasive materials, and other cutting elements known to those skilled in the art. However, in further embodiments, the cutting elements may be located elsewhere on the knife arms 140, for example, along the entire length of each knife arm 140.

Each knife arm 140 also includes a narrow engaging portion on its underside in the form of an elongate linear projection to engage with a respective reaming block 240*a* and a respective recess of the knife ramp support block 221. The engaging portion extends centrally from the distal portion of the knife arm 140 to about the centre of the knife arm 140, along its length. However, in further embodiments, the engaging portion may be differently shaped depending on the shape of the corresponding engaging portion of the reaming blocks 240*a*.

The inner mandrel 120 is connected to and extends from an end of the J-slot portion 130, through the outer assembly 200 and terminates in a pressure chamber 217 of the outer assembly 200. Drilling fluid is pumped into the inner mandrel 120 from the first end 11 of the DSSM 10 (through the central bore of the inner housing 110) and flows out through the other end of the inner mandrel 120 into the pressure chamber 217, exiting the DSSM 10 at its second end 12.

The outer assembly 200 includes a cylindrical outer housing 210, a piston assembly 220 for extending reaming blocks 240*a*, 240*b*, and a shear assembly 230 to prevent premature movement of the outer assembly 200 with respect to the inner assembly 100. The outer assembly 200 extends from the second end 12 of the DSSM 10 and terminates at a distance from the first end 11 of the DSSM 10, i.e. there is a substantial overlap between the inner and outer assemblies 100, 200, with a substantial portion of inner assembly 100 located in the outer assembly 200.

The outer housing 210 of the outer assembly 200 is hollow and comprises a knife portion 211, a middle portion 212, a nozzle portion 213 and a bottom portion 214. An end of the knife portion 211 that is proximate to the first end 11 of the DSSM 10 is connected to a debris cap 215, with the other end of the knife portion 211 being connected to an end of the middle portion 212. The other end of the middle portion 212 (that is not connected to the knife portion 211) is connected to an end of the nozzle portion 213 and the other end of the nozzle portion 213 (that is not connected to the middle portion 212) is connected to an end of the bottom portion 214. The other end of the bottom portion 214 (that is not connected to the nozzle portion 213) forms the second end 12 of the DSSM 10. However, in further embodiments, the outer housing 210 may comprise only two or five or more portions connected to each other or the outer housing 210 may be integrally formed.

The knife portion 211 of the outer housing 210 includes several cut-outs for the knife arms 140 and reaming blocks 240*a*, 240*b* to extend radially outwards from the knife portion 211 of the outer housing 210 of the DSSM 10. Each cut-out is located adjacent to one of the knife arms 140 or reaming blocks 240*a*, 240*b* and is sized such that a portion of the knife arm 140 or reaming block 240*a*, 240*b* can extend outwardly through the cut-out.

The knife portion 211 of the outer housing 210 encases the J-slot portion 130 of the inner housing 110 and includes internal lugs extending radially inwards from the inner wall of the knife portion 211, with each lug engaging with one of the recesses (J-slots) of the J-slot portion 130. The mating of the internal lugs of the knife portion 211 of the outer housing 210 with the recesses of the J-slot portion 130 of the inner housing 110 allows for rotational torque to be transmitted to the outer assembly 200 from the inner assembly 100, i.e. the outer assembly 200 can be rotated by rotating the inner assembly 100.

The piston assembly 220 extends through the knife portion 211, the middle portion 212 and the nozzle portion 213 of the outer housing 210 and includes a knife ramp support block 221 to which the reaming blocks 240*a*, 240*b* are connected, a wedge rod 222 extending partially through the knife ramp support block 221, a piston head 223 and a compression spring 224 located between the wedge rod 222 and the piston head 223. Both, the knife ramp support block 221 and the wedge rod 222, have a hollow central tubular portion, with the inner mandrel 120 extending through the hollow portion of the wedge rod 222 and the wedge rod 222 extending through the hollow portion of the knife ramp support block 221.

An end of the knife ramp support block 221 that is proximal to the first end 11 of the DSSM 10 has a frustoconical portion with three recesses, each recess providing a path for a knife arm 140 to slide along. The recesses are equally spaced from each other and run substantially along the entire length of the frustoconical portion. However, in further embodiments, the frustoconical portion of the knife ramp support block 221 may be differently shaped and/or include only one, two or four or more recesses depending on the number of knife arms 140.

The main body of the knife ramp support block 221 (without the frustoconical portion) is tubular in shape with three elongate cut-outs formed in the wall of the knife ramp support block 221. The cut-outs of the main body of the knife ramp support block 221 are equally radially spaced from each other and extend completely through the wall of the knife ramp support block 221.

Each cut-out of the main body of the knife ramp support block 221 has two reaming blocks 240*a*, 240*b* located therein, with the reaming blocks 240*a* longitudinally spaced from the reaming blocks 240*b* along the cut-out, i.e. three reaming blocks 240*a* are pivotally connected to the knife ramp support block 221 proximate to the end with the frustoconical portion and the other three reaming blocks 240*b* are pivotally connected to the knife ramp support block 221 proximate to the other end of the knife ramp support block 221 that is distal to the frustoconical portion. When the reaming blocks 240*a*, 240*b* are in the retracted configuration and located completely inside the outer housing 210, each of the reaming blocks 240*a*, 240*b* extends towards the second end 12 of the DSSM 10. When extended, each of the reaming blocks 240*a*, 240*b* pivots radially outwards towards the first end 11 of the DSSM 10.

The reaming blocks 240*a* are equally radially spaced from each other and are also equally longitudinally spaced from their respective reaming blocks 240*b* (that are located in the same cut-out). Similar to the reaming blocks 240*a*, the reaming blocks 240*b* are also equally radially spaced from each other.

Similar to the knife arms 140, the distal portion of each reaming block 240*a*, 240*b* includes a plurality of cutting elements. Any cutting elements suitable for milling/removing cement may be utilized including, but not limited to, polycrystalline diamond cutter (PDC) inserts, thermally stabilized polycrystal line (TSP) inserts, diamond inserts, glyphaloy carbide inserts, boron nitride inserts, abrasive materials, and other cutting elements known to those skilled in the art. However, in further embodiments, the cutting elements may be located elsewhere on the reaming blocks 240*a*, 240*b*, for example, along the entire length of each reaming block 240*a*, 240*b*.

Each of the reaming blocks 240*a* also includes an engaging portion in the form of an elongate linear recess to engage with the engaging portion of each respective knife arm 140. The engaging portion of each reaming block 240*a*, 240*b* extends centrally along the length of the reaming block 240*a*, 240*b*. Although, in use, only the engaging portions of reaming blocks 240*a* engage with engaging portions of respective knife arms 140, the reaming blocks 240*a* and reaming blocks 240*b* are identical in shape to allow for interchangeability and ease of manufacture.

The wedge rod 222 is in the shape of a hollow cylinder with two sets of projections extending radially outwards from the wall of the wedge rod 222. Each set of the projections includes three equally radially spaced projections, with each projection having a trapezoidal shape and the two sets of projections being longitudinally spaced from each other. The projections of the wedge rod 222 align with and extend through the cut-outs of the main body of the knife ramp support block 221 such that movement of the wedge rod 222 relative to the knife ramp support block 221 results in the projections of the wedge rod 222 sliding longitudinally in the cut-outs of the main body of the knife ramp support block 221.

The portion of the wedge rod 222 with the projections extends through the knife ramp support block 221 while the remaining body of the wedge rod 222 extends through the middle portion 212 of the outer housing 210 and is connected to the piston head 223 at an end of the wedge rod 222 such that movement of the piston head 223 relative to the outer housing 210 results in the movement of the wedge rod 222 relative to the knife ramp support block 221. The spring 224 is also located in the middle portion 212 of the outer housing 210 and extends around the wedge rod 222, between the knife ramp support block 221 and the piston head 223, i.e. the wedge rod 222 extends through the central cavity of the spring 224 along its longitudinal axis.

The piston head 223 has a hollow cylindrical body with a first end facing the first end 11 of the DSSM 10 and a second end facing the second 12 of the DSSM 10, with the inner mandrel 120 extending through the piston head 223 from the first to second end. The opening at the first end of the piston head 223 is sized such that no fluid can flow through the opening while the inner mandrel 120 extends through it (except the fluid flowing through the inner mandrel 120 itself). The opening at the second end of the piston head 223 is larger than the opening at the first end of the piston head 223 and allows for fluid to enter the hollow body of the piston head 223.

The nozzle portion 213 of the outer housing 210 includes a plurality of nozzles 216 in the form of apertures (not shown in FIGS. 4-6) located in the cylindrical wall of the nozzle portion 213. The nozzles 216 extend substantially through the wall of the nozzle portion 213 such that fluid can flow from inside the hollow body of the nozzle portion 213, through the nozzles 216 and to the exterior of the outer housing 210. The internal openings of the nozzles 216 are normally restricted by the piston head 223 and become unrestricted only when the piston head 223 moves towards the first end 11 of the DSSM 10.

The bottom portion 214 has a first section, a second section (at the second end 12 of the DSSM 10) and an intermediate section located between the first and second sections. The internal diameter of the first section is greater than the internal diameter of the second section, with the internal diameter of the intermediate section tapering from the internal diameter of the first section to the internal diameter of the second section. The first section of the bottom portion 214 forms the pressure chamber 217 into which the drilling fluid flows as it exits the inner mandrel 120.

A plate 218 is located at the junction of the first and intermediate sections of the bottom portion 214. The plate 218 is disc-shaped with a plurality of apertures formed through the plate 218 such that the drilling fluid can flow through the apertures from first section to the second section of the bottom portion 214.

The shear assembly 230 comprises a shear sleeve 231, a shear member 232 releasably connected to the shear sleeve 231 and a plurality of shear pins 233 (not shown in FIGS. 4-6) located in the region where the shear sleeve 231 and shear member 232 are connected to each other. The shear sleeve 231 is connected to the end of the nozzle portion 213 that is connected to the bottom portion 214 and extends towards the second end 12 of the DSSM, through the bottom portion 214. The shear sleeve 231 has a hollow cylindrical body with the inner mandrel 120 extending therethrough and includes a plurality of apertures in the portion that engages with the nozzle portion 213 such that fluid can flow from the bottom portion 214, through the apertures and into the nozzle portion 213.

The shear member 232 also has a hollow cylindrical body with a portion of the shear member 232 extending through the inner mandrel 120. The other portion of the shear member 232 which does not extend through the inner mandrel 120 has a comparatively smaller diameter that tapers towards the second end 12 of the DSSM 10.

The shear pins 233 prevent disengagement of the shear member 232 from the shear sleeve 231, with a portion of each shear pin 233 being engaged with the shear sleeve 231 and another portion of each shear pin 233 being engaged with the shear member 232. The shear member 232 disengages from the shear sleeve 231 only when the shear pins 233 have been sheared due to application of force.

Figures 4, 5, 6:
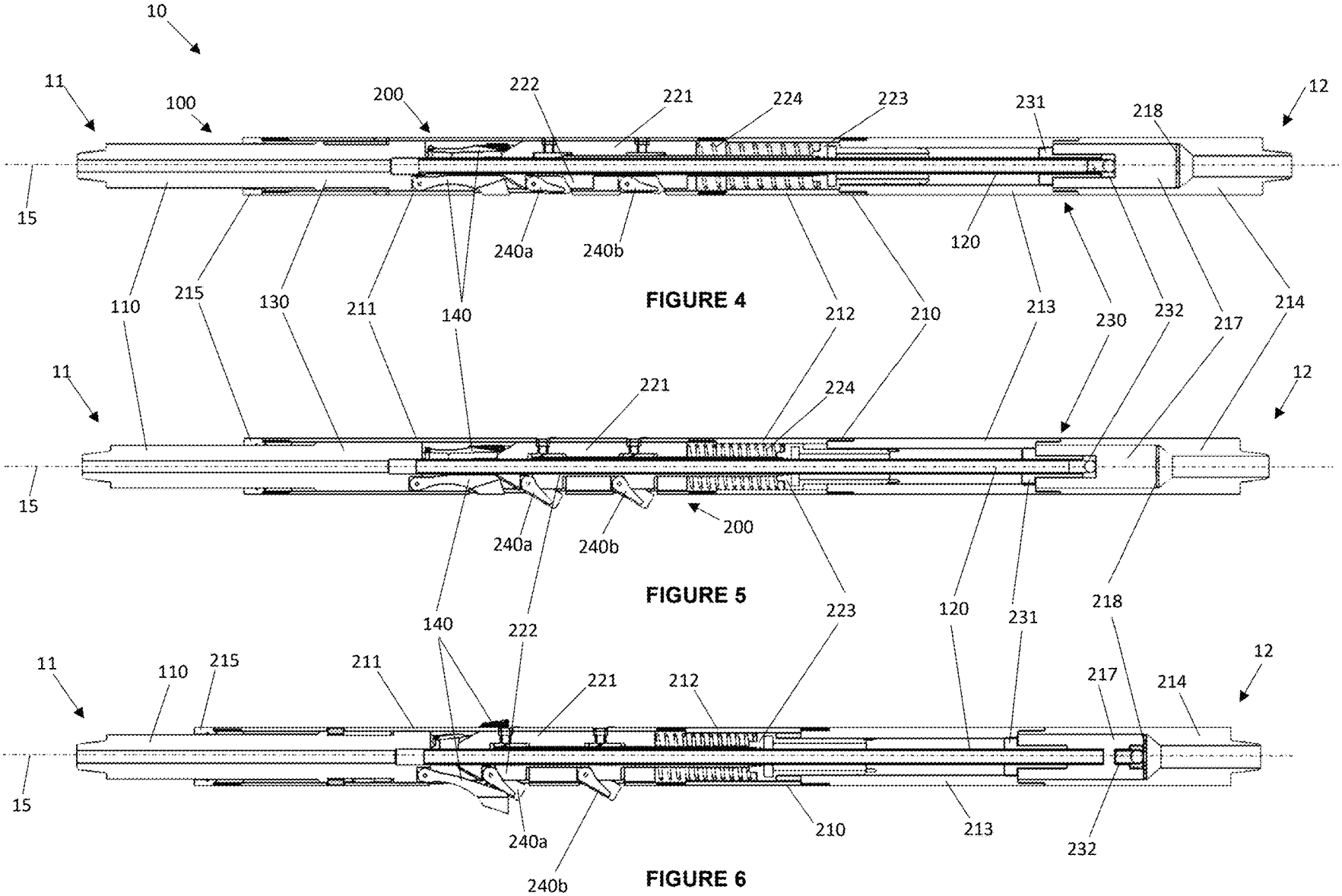
FIG. 4 illustrates an alternative cross-sectional view of the milling tool shown in FIG. 1.
FIG. 5 illustrates a cross-sectional view of the milling tool shown in FIG. 4 with the reaming blocks extended.
FIG. 6 illustrates a cross-sectional view of the milling tool shown in FIG. 4 with the knife arms and reaming blocks extended.

The milling tool (DSSM 10) is used to mill a window (a circumferential cut along a length of the string) in an outer casing string of a dull-string wellbore, as well as to remove cement or other debris located in the window of the inner casing string and/or between the inner and outer casing strings. To mill a window in the outer casing string, the inner casing string is first milled by a separate milling tool to create a window in the inner casing string. The separate milling tool is retracted from the wellbore and the DSSM 10 is inserted (with the second end 12 as the leading end) into the wellbore in its place, with the DSSM 10 being in a closed position in which the knife arms 140 and the reaming blocks 240*a*, 240*b* are located entirely inside the outer housing 210 (as shown in FIGS. 1 and 4).

The DSSM 10 is first located at a point in the wellbore that is approximately 2 metres above the window of the inner casing string. The drilling fluid is then pumped into the DSSM 10 through the first end 11 and into the pressure chamber 217 (via the inner mandrel 120). The flow of the fluid out of bottom portion 214 is restricted due to the apertures provided in the plate 218 which leads to build-up of hydraulic pressure inside the pressure chamber 217. The pressure exerts a force on the first end of the piston head 223 causing it to move towards the first end 11 of the DSSM 10. The movement of the piston head 223 also causes the wedge rod 222 to move relative to the knife ramp support block 221 (towards the first end 11 of the DSSM 10), thereby resulting in the projections of the wedge rod 222 moving along the cut-outs of the knife ramp support block 221 and causing the reaming blocks 240*a*, 240*b* to extend and pivot radially outwards through the cut-outs in the knife portion 211.

However, the extension of the reaming blocks 240*a*, 240*b* is greatly limited by the restricted space (clearance) between the DSSM 10 and the wall of the inner casing string, i.e. only a small portion of each of the reaming blocks 240*a*, 240*b* extends out of the outer housing 210 and is in contact with the wall of the inner casing string. With the pressure of the fluid being maintained, the DSSM 10 is further lowered into the wellbore until a reduction in the pressure of the fluid is observed. The reduction in the fluid pressure occurs when the DSSM 10 is lowered to a point where the reaming blocks 240*a*, 240*b* can extend completely (i.e. they extend into the window formed in the inner casing string) and the piston head 223 has moved sufficiently towards the first end 11 of the DSSM 10 so as to allow flow of fluid through the nozzles 216. The reaming blocks 240*a*, 240*b* are able to extend to a maximum predetermined position, with the extension of the reaming blocks 240*a*, 240*b* being limited by a respective extension stop plate located on each reaming block 240*a*, 240*b*. With the reaming blocks 240*a*, 240*b* fully extended, the DSSM 10 is considered to have moved from a closed position to a first open position (as shown in FIGS. 2 and 5).

The depth at which the reduction in the pressure of the fluid is observed provides a depth of the top end of the window formed in the inner casing string. The DSSM 10 is then lowered further such that the reaming blocks 240*a* are located about 0.5 metres below the top end of the window formed in the inner casing string. Rotation of the DSSM 10 is then commenced (while the fluid pressure is maintained) by applying rotational torque to the inner housing 110 which causes the outer assembly 200 (including the reaming blocks 240*a*, 240*b*) to rotate. The rotation of the reaming blocks 240*a*, 240*b* in the window formed in the inner casing string cleans the window of cement and other debris. Notably, even when the reaming blocks 240*a*, 240*b* are full extended to the maximum predetermined position, no portion of the outer casing string is milled or cut as the extension of the reaming blocks 240*a*, 240*b* is appropriately configured. The entire length of the window formed in the inner casing string is cleaned by the reaming blocks 240*a*, 240*b* by lowering the DSSM 10 until set-down weight is observed on the reaming blocks 240*b* (due to contact with the bottom end of the window formed in the inner casing string). The depth at which the set-down weight is observed confirms the depth/length of the window formed in the inner casing string.

Next, rotation of the DSSM 10 is stopped and the DSSM 10 is raised/retracted slowly so as to allow the extended reaming blocks 240*a*, 240*b* to travel along the full length of the window formed in the inner casing string. If no overpull or set-down weight is observed, the window formed in the inner casing string is deemed to have been scrubbed clean by the reaming blocks 240*a*, 240*b*. However, if any overpull or set-down weight is observed when the reaming blocks 240*a*, 240*b* are travelling along the length of the window formed in the inner casing string, the rotation of the DSSM 10 is recommenced and the reaming blocks 240*a*, 240*b* are used to continue cleaning the window until no overpull or set-down weight is observed upon moving the reaming blocks 240*a*, 240*b* along the length of the window when the DSSM 10 is not rotating.

Once it has been determined that the window formed in the inner casing string has been cleaned by the reaming blocks 240*a*, 240*b*, the circulation of drilling fluid and rotation of the DSSM 10 is stopped. As the pressure of the fluid in the pressure chamber 217 drops, the spring 224 forces the piston head 223 to move towards the second end 12 of the DSSM 10, resulting in the reaming blocks 240*a*, 240*b* retracting back completely into the outer housing 210 until the DSSM 10 has moved back to the closed position.

A shear ball is then dropped into the inner mandrel 120 from the first end 11 of the DSSM 10 and the DSSM 10 is moved to a position in the wellbore where the cut-outs for the knife arms 140 in the knife portion 211 are located approximately 0.5 metres below the top end of the window formed in the inner casing string. The shear ball travels along the inner mandrel 120 until it reaches the shear member 232. The inner diameter of the shear member 232 is chosen such that further movement of the shear ball towards the second end 12 of the DSSM 10 is prevented. With the shear ball located in the shear member 232, the drilling fluid is recirculated through the inner mandrel 120 causing the shear pins 233 to shear due to build-up of pressure in the inner mandrel 120.

The shearing of the shear pins 233 results in a pressure drop of the fluid (which is observed to provide indication of shearing of the shear pins 233) as the shear member 232 is disengaged from the shear sleeve 231 and the fluid flows into the pressure chamber 217. The circulation of the fluid is stopped when the pressure drop is observed. The shear member 232 and the shear pins 233 drop into the pressure chamber 217 onto the plate 218.

Next, rotation of the DSSM 10 is commenced and torque is measured. The measured torque provides a reference for expected torque when the DSSM 10 can rotate freely without any resistance ('free torque'). The circulation of drilling fluid through the DSSM 10 is then restarted and, as the pressure of the fluid in the pressure chamber 217 increases, the piston head 223 moves towards the first end 11 of the DSSM 10 and the reaming blocks 240*a*, 240*b* are extended to their maximum extendable length. Further, with the shear member 232 disengaged from the shear sleeve 231, the shear sleeve 231 is now free to move along the inner mandrel 120. Accordingly, due to the pressure of the fluid in the pressure chamber 217, the entire outer assembly 200 moves relative to the inner assembly 100 towards the first end 11 of the DSSM 10.

As the knife ramp support block 221 of the outer assembly 200 moves towards the first end 11 of the DSSM 10, the engaging portions of the knife arms 140 slide along the respective recesses of the frustoconical portion of the knife ramp support block 221 to extend the knife arms 140 radially outwards from the respective cut-outs in the knife portion 211 until the distal tips of the knife arms 140 come into contact with the outer casing string. However, the knife arms 140 are only partially extended (about half of the maximum possible extendable length) when they first come into contact with the outer casing string. Further, as the knife arms 140 extend outwards from the cut-outs of the knife portion 211, the engaging portion on the underside of each knife arm 140 engages and slides along the engaging portion of its respective reaming block 240*a*. Thus, each reaming block 240*a* provides additional support to the respective knife arm 140.

As the DSSM 10 continues to rotate with the distal tips of the knife arms 140 in contact with the outer casing string, the knife arms 140 begin to cut the outer casing string. The torsional stresses acting on the knife arms 140 are distributed to the J-slot portion 130 of the inner housing 110 by the pivot pins which connect the knife arms 140 to the J-slot portion 130 and by the engagement of the engaging portions of the knife arms 140 and the reaming blocks 240*a*.

The knife arms 140 are able to extend to a maximum predetermined position, with the extension of the knife arms 140 being limited by a respective extension stop plate located on each knife arm 140. When the entire thickness of the wall of the outer casing string has been milled by the knife arms, the knife arms 140 (and the reaming blocks 240*a*, 240*b*) are fully extended and the DSSM 10 is considered to have moved to a second open position (as shown in FIGS. 3 and 6).

The torque is continually measured as the DSSM 10 rotates and the knife arms 140 mill the outer casing string. Reduction of the torque to the value previously measured as the 'free torque' indicates that the particular section of the outer casing string has been completely cut/milled by the knife arms 140. The DSSM 10 is lowered in the wellbore, while rotating, to allow the knife arms 140 to cut the outer casing string along the window formed in the inner casing string until the reaming blocks 240*b* are approximately 0.5 metres above the bottom end of the window formed in the inner casing string. This results in the formation of a window in the outer casing string with a total length/depth of approximately 2 metres less than the total length/depth of the window formed in the inner casing string.

Next, rotation of the DSSM 10 is stopped and the DSSM 10 is raised/retracted slowly so as to allow the extended knife arms 140 to travel along the full length of the window formed in the outer casing string. If no overpull or set-down weight is observed, the window formed in the outer casing string is deemed to have been milled clean by the knife arms 140. However, if any overpull or set-down weight is observed when the knife arms 140 are travelling along the length of the window formed in the outer casing string, the rotation of the DSSM 10 is recommenced and the knife arms 140 are used to continue cleaning the window until no overpull or set-down weight is observed upon moving the knife arms 140 along the length of the window when the DSSM 10 is not rotating.

Once it has been determined that the window formed in the outer casing string has been cleaned by the knife arms 140, the circulation of drilling fluid and rotation of the DSSM 10 is stopped. As the fluid pressure in the pressure chamber 217 drops, the piston head 223 and remaining the outer assembly 200 move downwards towards the second end 12 of the DSSM 10 resulting in the knife arms 140 and the reaming blocks 240*a*, 240*b* being retracted completely into the outer housing 210 and the DSSM 10 moving back to the closed position.

The milling tool (DSSM 10) provides several advantages over similar known milling tools. The DSSM 10 is capable of cleaning the window formed in the inner casing string, as well as cutting a window in the outer casing string, without requiring the DSSM 10 to be retracted from the wellbore. Further, engagement of the knife arms 140 with the reaming blocks 240*a* provides additional support for the knife arms 140 against failure of the knife arms 140 due to excessive torsional stresses, while having two sets of reaming blocks 240*a*, 240*b* provides stability to the milling tool when in use. The DSSM 10 can also be used as an under-reaming tool by replacing the knife arms 140 with suitable under-reaming arms. The DSSM 10, when used as an under-reaming tool, can under-ream single string casing window to expose new formation for cement barrier placement, enlarge wellbores for greater cement coverage and zone isolation, and/or enlarge wellbores for gas injection storage.

Figures 7A, 7B:
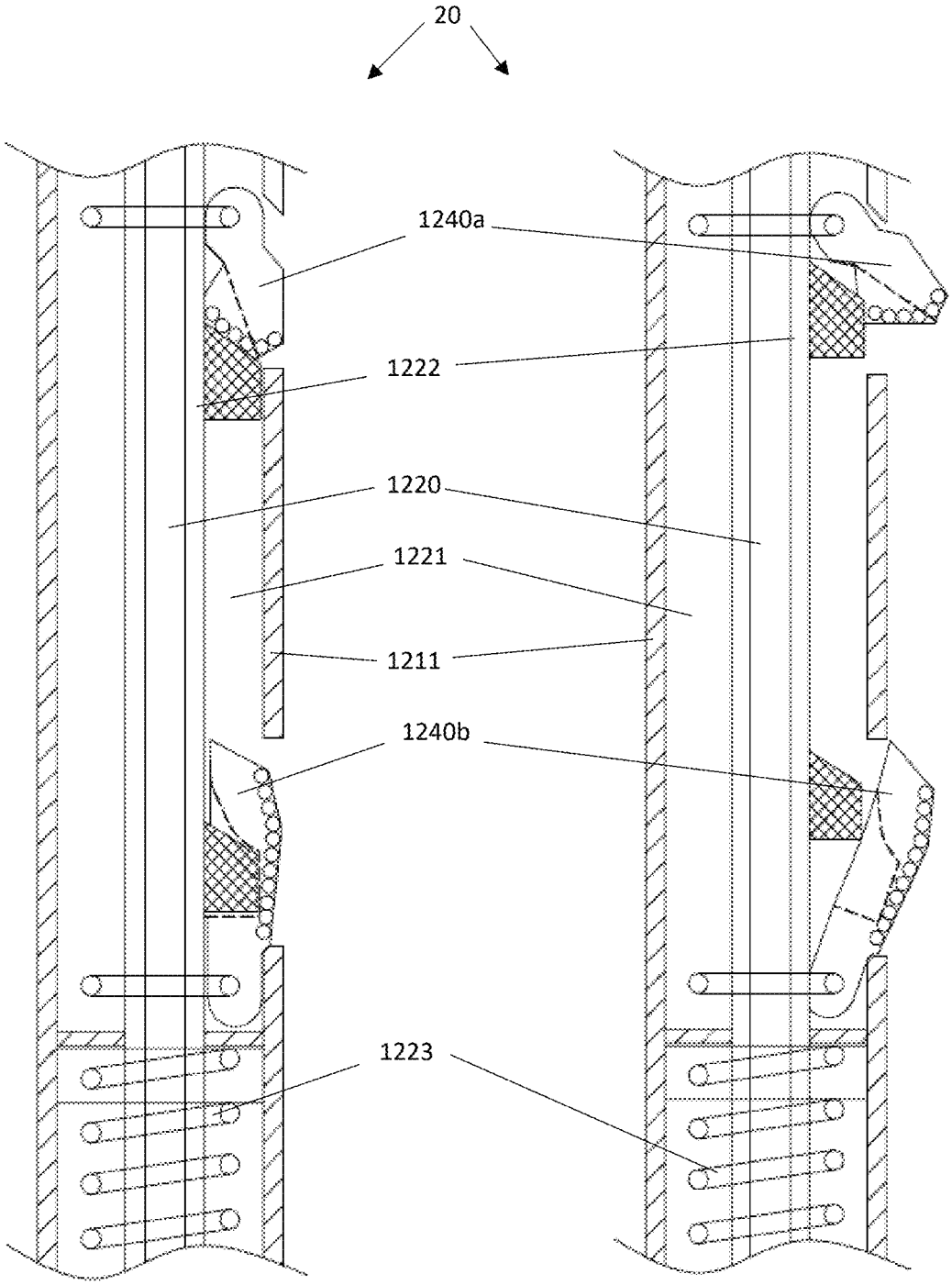
FIGS. 7A and 7B illustrate partial cross-sectional views of a piston assembly of a milling tool according to a further embodiment of the invention.

FIGS. 7A and 7B illustrate a portion of a piston assembly of a milling tool according to a further embodiment of the invention. The milling tool is in the form of a dual string section mill (DSSM) 20 and is substantially similar to the DSSM 10 with differences therebetween noted below.

Like the DSSM 10, the DSSM 20 includes a piston assembly 1220 having a knife ramp support block 1221 (partially shown), a wedge rod 1222 (partially shown), a piston head 1223 (not shown) and a compression spring 1224 (partially shown). The piston assembly 1220 also includes reaming blocks 1240*a*, 1240*b* pivotally connected to the knife ramp support block 1221. However, unlike the reaming blocks 240*a*, 240*b* of the DSSM 10, the reaming blocks 1240*a* and reaming blocks 1240*b* are not identical to each other and extend/pivot in opposite directions. Although, in their retracted configuration, the reaming blocks 1240*a* extend towards the second end 22 (not shown) of the DSSM 20 (which is located beyond the spring 1223), the reaming blocks 1240*b* extend towards the first end (not shown) of the DSSM 20 (which is located beyond the reaming blocks 1240*a*), i.e. the reaming blocks 240*a*, 240*b* extend in opposite directions relative to each other. Accordingly, when the wedge rod 1222 moves towards the first end relative to the knife ramp support block 1221, the first set of projections of the wedge rod 1222 cause the reaming blocks 1240*a* to pivot radially outwards towards the first end while the second set of projections of the wedge rod 1222 cause the reaming blocks 1240*b* to pivot radially outwards towards the second end 22 of the DSSM 20.

Further, although the reaming blocks 1240*a* are similar in shape to the reaming blocks 240*a*, 240*b*, the reaming bocks 1240*b* are differently shaped and are larger than the reaming blocks 1240*a*. The larger reaming bocks 1240*b* allow for greater surface contact for reaming/cutting cement to clean the window formed in the inner casing string and also provide greater stability.

Figure 8:
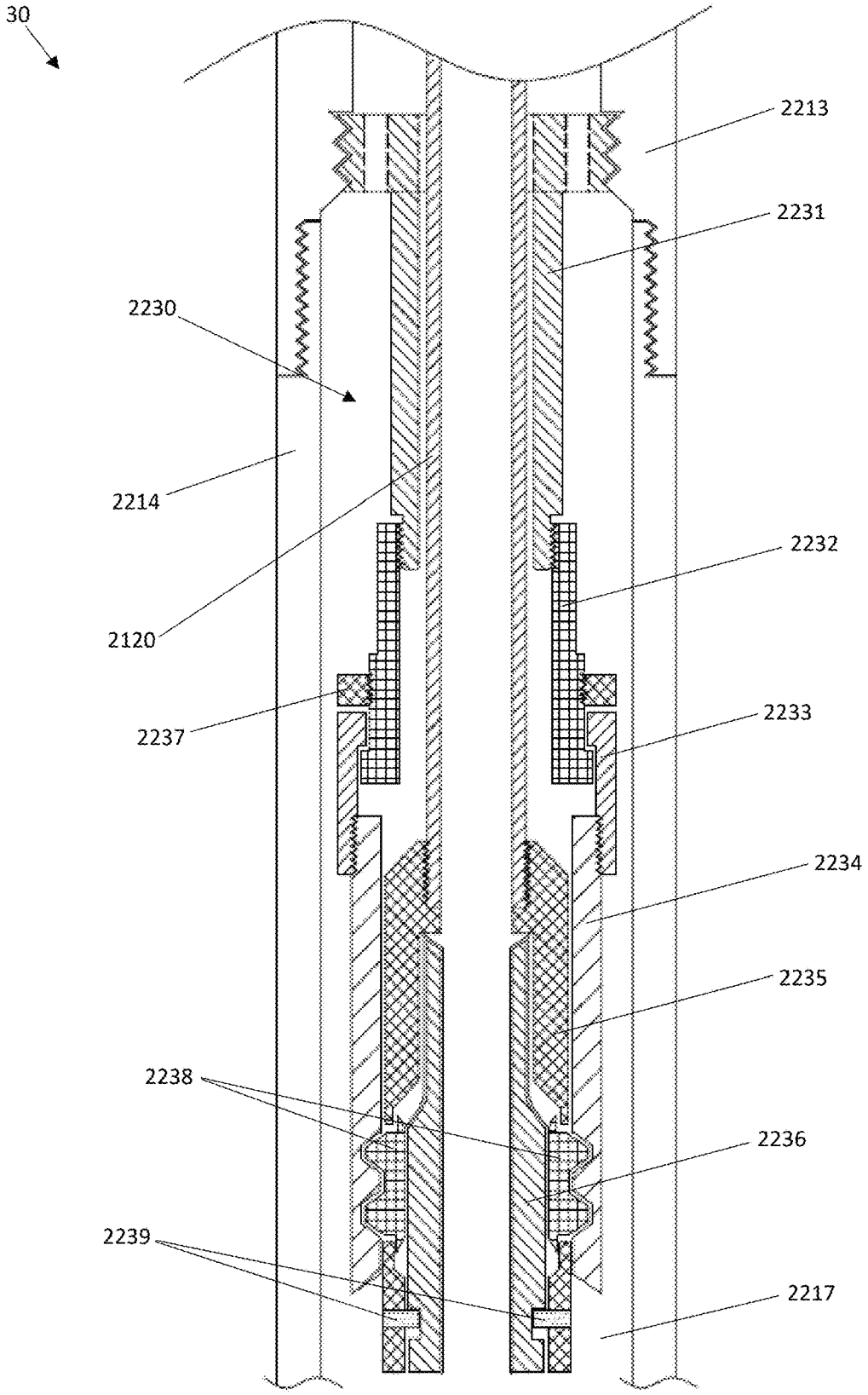
FIG. 8 illustrates a cross-sectional view of a shear assembly of a milling tool according to a further embodiment of the invention.

FIG. 8 illustrates a shear assembly 2230 of a milling tool according to a further embodiment of the invention. The milling tool is in the form of a dual string section mill (DSSM) 30 and is substantially similar to the DSSM 20 with differences therebetween noted below.

Like the DSSM 20, the DSSM 30 includes a shear assembly 2230. However, the shear assembly 2230 of the DSSM 30 is differently shaped and operates in a different manner. The shear assembly 2230 comprises a shear sleeve 2231 (in the form of an outer disconnect anchor member), a shoulder member 2232, an adjustment collar 2233, an outer disconnect member 2234, an inner disconnect member 2235 and a disconnect sleeve 2236. The shear sleeve 2231 is connected to the end of the nozzle portion 2213 that is connected to the bottom portion 2214 and extends towards the second end 212 (not shown) of the DSSM, through the bottom portion 2214. The shear sleeve 2231 has a hollow cylindrical body with the inner mandrel 2120 extending therethrough and includes a plurality of apertures in the end that engages with the nozzle portion 2213 such that fluid can flow from the pressure chamber 2217 (partially shown) of the bottom portion 2214, through the apertures and into the nozzle portion 2213.

The other end of the shear sleeve 2231 (that is not connected to the nozzle portion 2213) is threadingly connected to an end of the shoulder member 2232. The shoulder member 2232 has a hollow cylindrical body with the inner mandrel 2120 extending therethrough and an internal diameter that is greater than the internal diameter of the shear sleeve 2231. The other end of the shoulder member 2232 (that is not connected to the shear sleeve 2231) has a radial flange extending radially outwards that engages with and supports a corresponding radial flange (that extends radially inwards) located at an end of the adjustment collar 2233. The shoulder member 2232 also has an intermediate threaded portion that threadingly engages with a locking ring 2237. The locking ring 2237 can be used to tighten the engagement of the flanges of the shoulder member 2232 and the adjustment collar 2233 with each other.

The adjustment collar 2233 has a hollow cylindrical body with an internal diameter that is greater than the internal diameter of the shoulder member 2232. The other end of the adjustment collar 2233 (this is not engaged with the shoulder member 2232) is threadingly connected to an end of the outer disconnect member 2234.

The outer disconnect member 2234 also has a hollow cylindrical body with an external diameter that is less than the internal diameter of the adjustment collar 2233, and an internal diameter than is greater than the internal diameter of the shoulder member 2232. The other end of the outer disconnect member 2234 (that is not connected to the adjustment collar 2233) includes two circumferential recesses located on the inner wall of the outer disconnect member 2234, with the recesses being shaped to engage with radially outwardly extending projections of three locking members 2238 located between the outer disconnect member 2234 and the disconnect sleeve 2236.

The inner disconnect member 2235 has a hollow cylindrical body with an external diameter that is less than the internal diameter of the outer disconnect member 2234. The inner disconnect member 2235 is located inside the outer disconnect member 2234 with an end of the inner disconnect member 2235 being threadingly connected to the terminal end of the inner mandrel 2120. A radial flange extending radially inwards is formed at a point on the inner wall of the inner disconnect member 2235 immediately below the terminal end of the inner mandrel 2120. The inner disconnect member 2235 also includes three cut-outs formed on the body for the projections of the locking members 2238 to extend through.

The other end of the inner disconnect member 2235 (that is not connected to the inner mandrel 1220) includes four apertures for a portion of shearing pins 2239 to extend through. A portion of the shearing pins 2239 also extends through an external circumferential recess provided at an end of the disconnect sleeve 2236. However, in further embodiments, any number of shear pins 2239 (and corresponding number of apertures in the inner disconnect member 2235) and/or locking members 2238 (and corresponding number of cut-outs in the inner disconnect member 2235) may be used.

Each locking member 2238 has a base with an arcuate cross-sectional shape and two projections extending radially outwards from the base. The projections of each locking member 2238 extend through their respective cut-out in the inner disconnect member 2235 to engage with the recesses formed in the outer disconnect member 2234. Further, a portion of the base of each locking member 2238 extends beyond the respective cut-out in the inner disconnect member 2235 to engage with the inner disconnect member 2235. The base of each locking member 2238 is also in contact with the outer surface of the disconnect sleeve 2236.

The disconnect sleeve 2236 has a hollow cylindrical body with an internal diameter that is slightly less than the internal diameter of the inner mandrel 2120. The disconnect sleeve 2236 is located inside the inner disconnect member 2235 and is held in place by an O-ring (not shown) located between the disconnect sleeve 2236 and the inner disconnect member 2235, and the locking members 2238 (by compressive force exerted onto the disconnect sleeve 2236 by the locking members 2238). Movement of the disconnect sleeve 2236 relative to the inner disconnect member 2235 is further restricted by the shear pins 2239. The disconnect sleeve 2236 disengages from the inner disconnect member 2235 only when the shear pins 2239 have been sheared due to application of force.

In use, to move the DSSM 30 to the second open position (with the knife arms and the reaming blocks extended), a shear ball is first dropped into the inner mandrel 2120 from the first end 211 (not shown) of the DSSM 30. The shear ball travels along the inner mandrel 2120 until it reaches the inner disconnect member 2235. The inner diameter of the inner disconnect member 2235 is chosen such that further movement of the shear ball towards the second end 212 of the DSSM 30 is prevented. The drilling fluid is then circulated through the inner mandrel 120 causing the shear pins 2239 to shear due to build-up of pressure in the inner mandrel 2120. The inner disconnect member 2235, the shear pins 2239 and the locking members 2238 drop into the pressure chamber 2217 onto the plate 2218 (not shown). With the locking members 2238 disengaged from the outer disconnect member 2234 and the inner disconnect member 2235, the inner disconnect member 2235 is free to move relative to the outer disconnect member 2234, which allows the outer assembly to move relative to the inner assembly to move the DSSM 30 to the second open position.

The shear assembly 2230 can be used with the DSSM 10 in place of the shear assembly 230, or with any other tool where a hydraulic disconnect/shear assembly is required. Further, the shear assembly 2230 may be used in other milling tools configured to cut an outer casing string and/or an inner casing string of a wellbore.

The configuration and design of the shear assembly 2230 prevents premature shearing of the shearing pins 2239 (due to shock loads or rotational stress experienced during drilling operation) by transferring and applying the loads to the locking member 2238 instead of the shearing pins 2239, thereby isolating the shearing pins from any loads or stresses.

FIGS. 9A-F and 10A-C illustrate a milling tool according to a further embodiment of the invention. The milling tool is in the form of a dual string section mill (DSSM) 40 and is substantially similar to the DSSM 10 with differences therebetween noted below.

Like the DSSM 10, the DSSM 40 includes a piston assembly 3220 having a knife ramp support block 3221, a wedge rod 3222, a piston head 3223 and a compression spring 3224. The piston assembly 3220 also includes reaming blocks 3240*a*, 3240*b* pivotally connected to the knife ramp support block 3221. However, unlike the reaming blocks 240*a*, 240*b* of the DSSM 10, the reaming blocks 3240*a* and reaming blocks 3240*b* are not identical to each other and extend/pivot in opposite directions, similar to the reaming blocks 1240*a*, 1240*b* of the DSSM 20. Accordingly, when the wedge rod 3222 moves towards the first end 41 relative to the knife ramp support block 3221, the first set of projections of the wedge rod 3222 cause the reaming blocks 3240*a* to pivot radially outwards towards the first end 41 while the second set of projections of the wedge rod 3222 cause the reaming blocks 3240*b* to pivot radially outwards towards the second end 42 of the DSSM 40.

Further, like the DSSM 10, the DSSM 40 includes a shear assembly 3230. However, the shear assembly 3230 of the DSSM 40 is different from the shear assembly 230 of the DSSM 10, and is instead identical to the shear assembly 2230 of the DSSM 30.

Figure 9A:
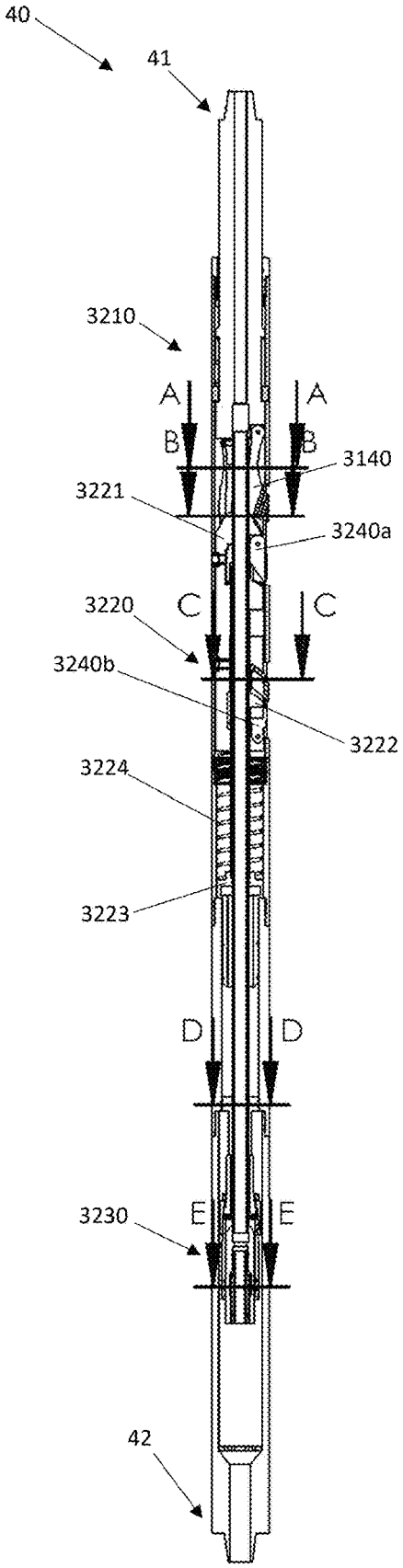
FIGS. 9A-F illustrate a cross-sectional view and multiple transverse cross-sectional views of a milling tool according to a further embodiment of the invention.
Figure 9B:
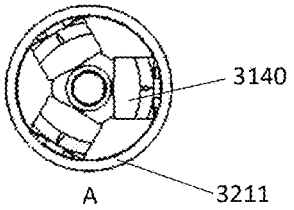
Figure 9C:
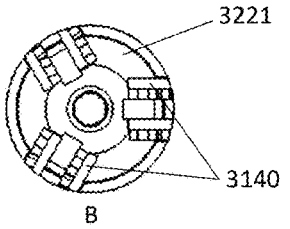
Figure 9D:
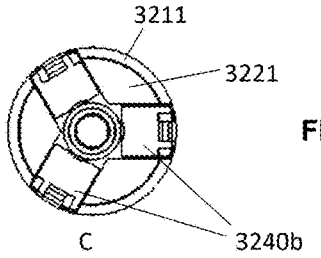
Figure 9E:
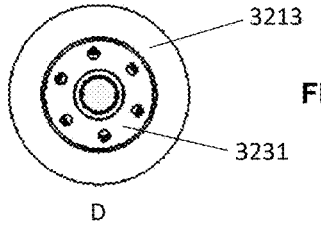
Figure 9F:
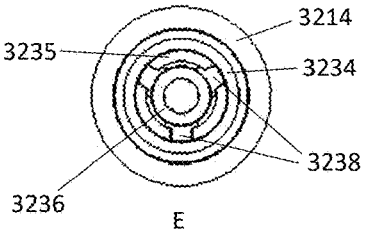

Transverse cross-section A (FIG. 9B) taken along 'A-A' of FIG. 9A shows the knife arms 3140 located entirely within the knife portion 3211 of the outer housing 3210. Transverse cross-section B (FIG. 9C) taken along 'B-B' of FIG. 9A shows the distal tips of the knife arms 3140 and the knife ramp support block 3221. Transverse cross-section C (FIG. 9D) taken along 'C-C' of FIG. 9A shows reaming blocks 3240*b* located entirely within the knife portion 3211 of the outer housing 3210 and the knife ramp support block 3221. Transverse cross-section D (FIG. 9E) taken along 'D-D' of FIG. 9A shows the shear sleeve 3231 and the nozzle portion 3213 of the outer housing 3210. Transverse cross-section E (FIG. 9F) taken along 'E-E' of FIG. 9A shows some of the components of the shear assembly 3230 (outer disconnect member 3234, an inner disconnect member 3235, disconnect sleeve 3236 and locking members 3238) located within the bottom portion 3214 of the outer housing 3210.

Figure 10A:
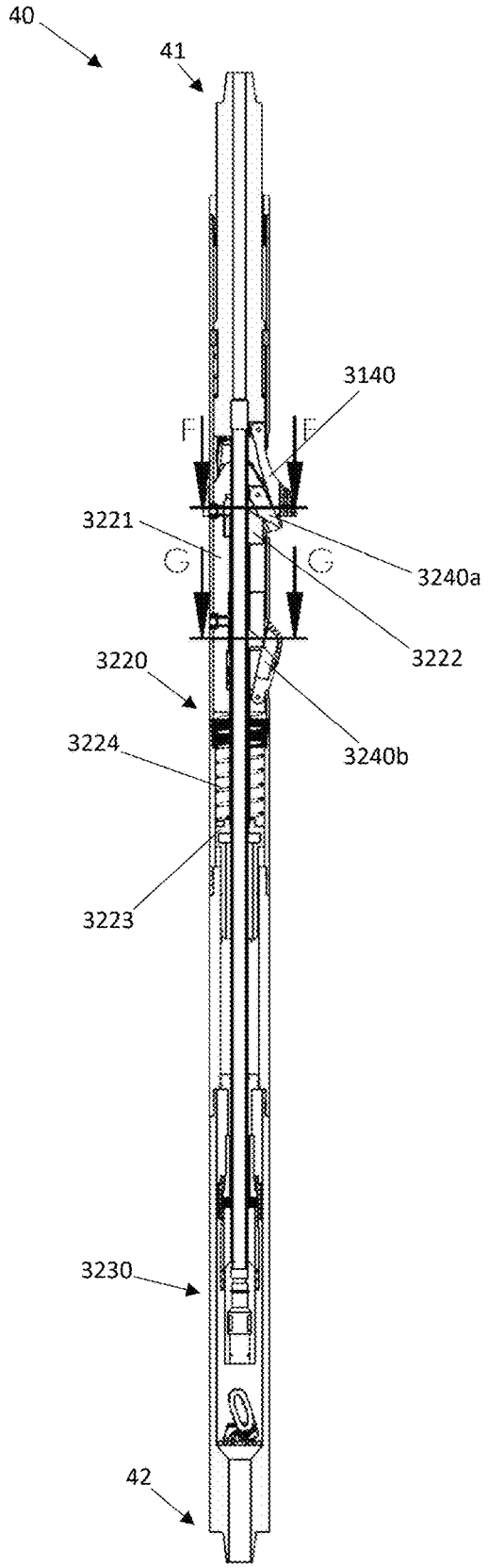
FIGS. 10A-C illustrate a cross-sectional view and multiple transverse cross-sectional views of the milling tool shown in FIG. 9 with the knife arm and reaming blocks extended.
Figure 10B:
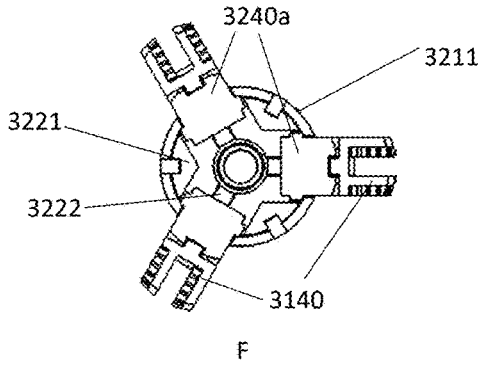
Figure 10C:
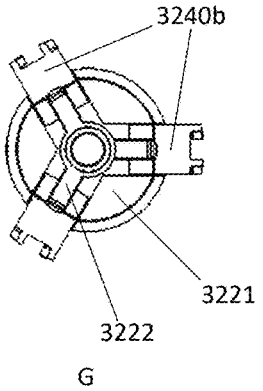

Transverse cross-section F (FIG. 10B) taken along 'F-F' of FIG. 10A shows the knife arms 3140 and reaming blocks 3240*a* extending outwardly from the knife portion 3211 of the outer housing 3210, and transverse cross-section G (FIG.

10C) taken along 'G-G' of FIG. 10A shows reaming blocks 3240*b* extending outwardly from the knife portion 3211 of the outer housing 3210.

FIGS. 11A-F and 12A-E illustrate a milling tool according to a further embodiment of the invention. The milling tool is in the form of a dual string section mill (DSSM) 50 and is substantially similar to the DSSM 40 with differences therebetween noted below.

Like the DSSM 40, the DSSM 50 includes a piston assembly 4220 having a knife ramp support block 4221, a wedge rod 4222, a piston head 4223 and a compression spring 4224. The piston assembly 4220 also includes reaming blocks 4240*a*, 4240*b* pivotally connected to the knife ramp support block 4221. However, unlike the reaming blocks 3240*a*, 3240*b* of the DSSM 40, the reaming blocks 4240*a* and reaming blocks 4240*b* extend/pivot in the same direction, towards the second end 52. Accordingly, when the wedge rod 4222 moves towards the first end 51 relative to the knife ramp support block 4221, the first and second set of projections of the wedge rod 4222 cause the reaming blocks 4240*a* and reaming blocks 4240*b* to pivot radially outwards towards the second end 52 of the DSSM 50.

Figures 11A, 11B, 11C, 11D, 11E, 11F:
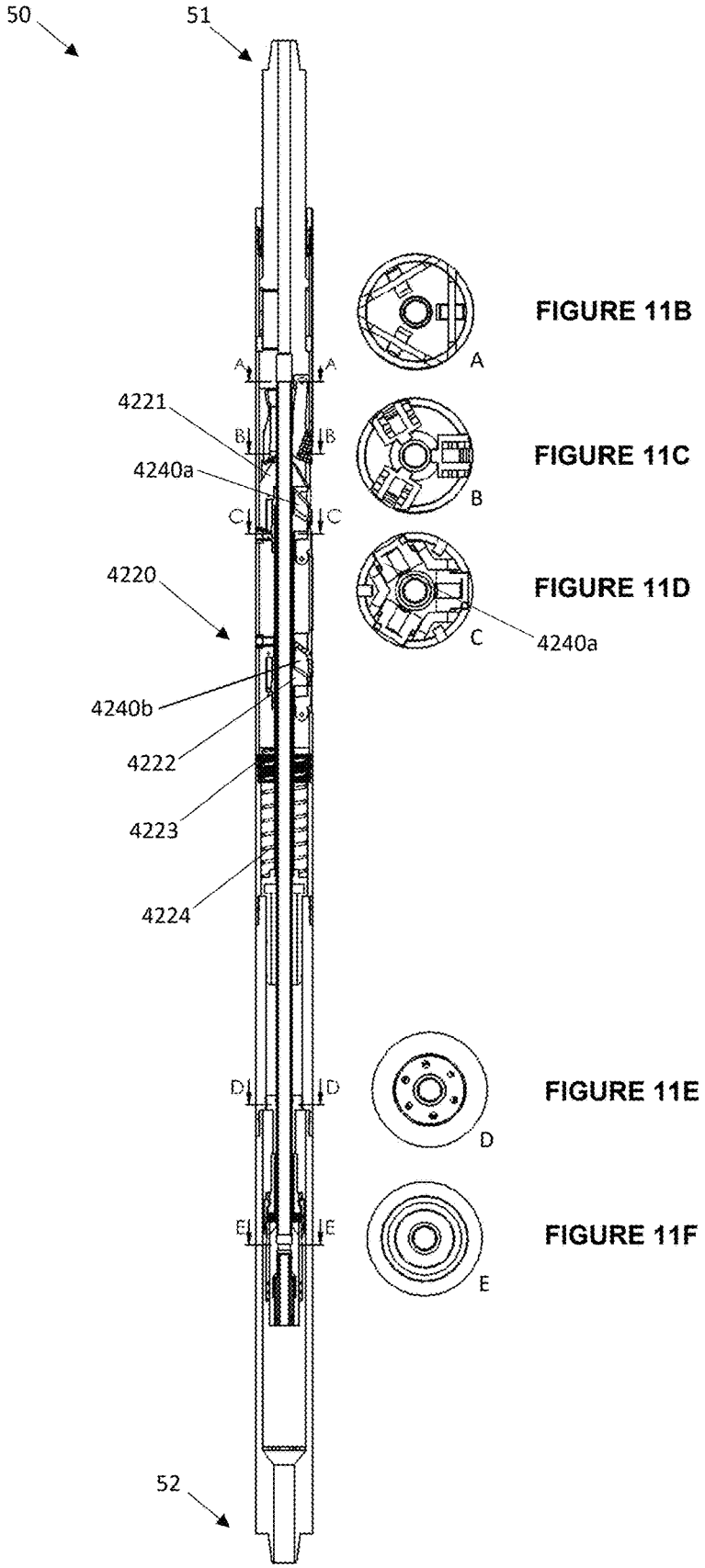
FIGS. 11A-F illustrate cross-sectional view and multiple transverse cross-sectional views of a milling tool according to a further embodiment of the invention.
Figures 12A, 12B, 12C, 12D, 12E:
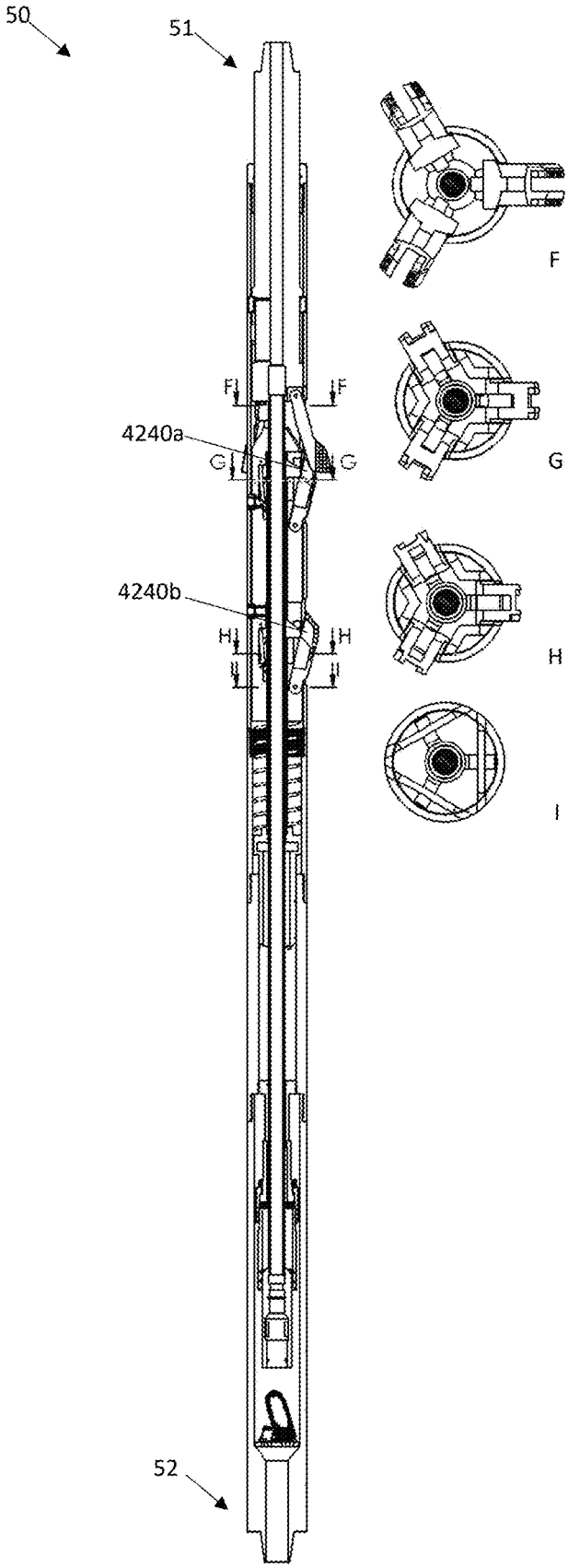
FIGS. 12A-E illustrate a cross-sectional view and multiple transverse cross-sectional views of the milling tool shown in FIG. 11 with the knife arm and reaming blocks extended.

FIGS. 11B-F and 12B-E also include transverse cross-sections A, B, C, D, E, F, G, H and I taken along 'A-A', 'B-B', 'C-C', 'D-D', 'E-E', 'F-F', 'G-G', 'H-H' and 'I-I' of FIGS. 11A and 12A, respectively.

Figure 13:
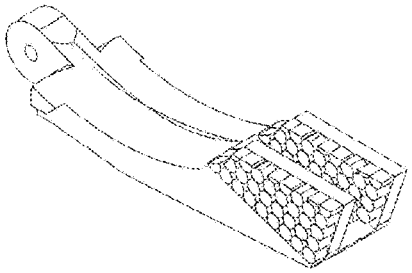
FIG. 13 illustrates a knife arm that can be installed in the milling tool shown in FIG. 1, 7A, 8, 9A-F or 11A-F.
Figure 14:
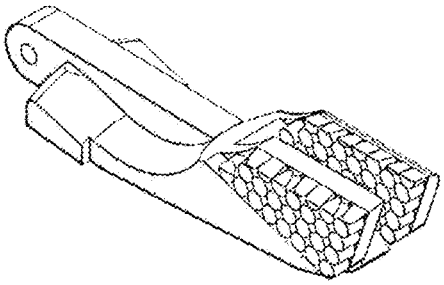
FIG. 14 illustrates an alternative knife arm that can be installed in the milling tool shown in FIG. 1, 7A, 9A-F or 11A-F.

FIGS. 13 and 14 illustrate two types of knife arms that can be used as the knife arms in DSSM 10, DSSM 20, DSSM 30 and/or DSSM 40.

Figure 15:
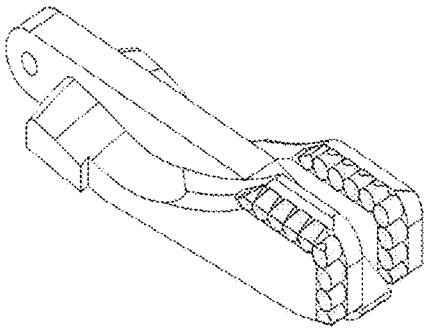
FIG. 15 illustrates a reaming block that can be installed in the tool shown in FIG. 1, 7A, 8, 9A-F or 11A-F.
Figure 16:
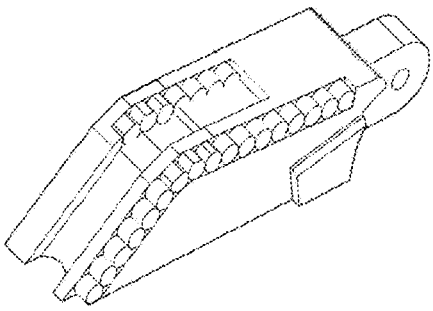
FIG. 16 illustrates an alternative reaming block that can be installed in the milling tool shown in FIG. 1, 7A, 8, 9A-F or 11A-F.

FIGS. 15 and 16 illustrate two types of reaming blocks that can be used as the reaming blocks in DSSM 10, DSSM 20, DSSM 30 and/or DSSM 40.

In this specification, adjectives such as first and second, forward and backward, upward and downward, top and bottom, proximal and distal, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

In this specification, the terms 'comprises', 'comprising', 'includes', 'including', or similar terms are intended to mean a non-exclusive inclusion, such that a method, system or apparatus that comprises a list of elements does not include those elements solely, but may well include other elements not listed.

The invention claimed is:

1. A milling tool for cutting an outer casing string of a wellbore, the milling tool comprising:

a tool body;

an extendable cutting member located in the tool body configured to cut the outer casing string; and an extendable reaming block located in the tool body configured to clean a window formed in an inner casing string of the wellbore, wherein the reaming block is configured to extend from the tool body independently from the cutting member, wherein the cutting member and the reaming block are configured to extend from the tool body by circulating drilling fluid through the milling tool, wherein an engaging portion of the cutting member engages with and abuts an engaging portion of the reaming block, wherein the tool body has an outer assembly that includes a piston assembly for extending the reaming block, the piston assembly including a knife ramp support block, wherein an end of the knife ramp support block has a recess, the recess providing a path for the cutting member to slide along a being configured to engage with the cutting member.

2. The milling tool of claim 1, wherein a distal end of the cutting member is configured to extend beyond a distal end of the reaming block.

3. The milling tool of claim 1, wherein the engaging portion of the cutting member is an elongate projection located on an underside of the cutting member.

4. The milling tool of claim 1, wherein the engaging portion of the reaming block is an elongate recess.

5. The milling tool of claim 1, wherein the tool body has an inner assembly, the outer assembly being slidable relative to the inner assembly, wherein the inner assembly has an inner housing and an inner mandrel connected to the inner housing, the inner housing having a central bore that provides a fluid pathway for the drilling fluid, and wherein the cutting member is connected to the inner housing.

6. The milling tool of claim 5, wherein sliding engagement of the outer assembly with the inner assembly extends the cutting member from the tool body.

7. The milling tool of claim 1, wherein the reaming block is connected to the knife ramp support block.

8. The milling tool of claim 7, wherein engagement of the knife ramp support block with the cutting member extends the cutting member from the tool body.

9. The milling tool of claim 7, wherein the piston assembly includes a wedge rod that extends through the knife ramp support block, and wherein engagement of a projection of the wedge rod with the reaming block extends the reaming block from the tool body.

10. The milling tool of claim 1, wherein the milling tool has a first extendable reaming block and a second extendable reaming block that is spaced from the first reaming block along a longitudinal axis of the milling tool.

11. The milling tool of claim 10, wherein the first and second reaming blocks extend in the same direction relative to the longitudinal axis of the milling tool and towards a first end of the milling tool.

12. The milling tool of claim 10, wherein the first and second reaming blocks extend in opposite directions.

13. The milling tool of claim 1, wherein the milling tool is configured to move between (i) a closed position where the cutting member and the reaming block are not extended, (ii) a first open position where the reaming block is extended and the cutting member is not extended, and (iii) a second open position where the cutting member and the reaming block are extended from the tool body.

14. The milling tool of claim 1, wherein the milling tool comprises a shear assembly, the shear assembly comprising:

a shear sleeve;

an outer disconnect member operatively connected to the shear sleeve;

an inner disconnect member releasably engaged with the outer disconnect member; and a disconnect sleeve releasably engaged with the inner disconnect member.

15. A method for cutting an outer casing string of a wellbore, the method comprising:

inserting a milling tool in the wellbore;

extending a reaming block located in a tool body of the milling tool;

cleaning, by the reaming block, a window formed in an inner casing string of the wellbore;

extending a cutting member located in the tool body; and cutting the outer casing string by the cutting member, wherein the cutting member and the reaming block are extended from the tool body by circulating drilling fluid through the milling tool, And wherein an engaging portion of the cutting member engages with and abuts an engaging portion of the reaming block, wherein extending the cutting member includes engaging the cutting member with a knife ramp support block of an outer assembly of the tool body, wherein an end of the knife ramp support block has a recess, the recess providing a path for the cutting member to slide along and being configured to engage with the cutting member.

16. The method of claim 15, wherein extending the reaming block includes moving a piston head located in the tool body by applying force on the piston head by the drilling fluid, and/or wherein extending the reaming block includes engaging a projection of a wedge rod with the reaming block.

17. The method of claim 15, wherein extending the cutting member includes extending a distal end of the cutting member beyond a distal end of the reaming block.

* * * * *